US005775123A

United States Patent [19]

Wakayama et al.

[11] Patent Number: 5,775,123

[45] Date of Patent: Jul. 7, 1998

[54] AIR CONDITIONER AIR TURNING VANE

[75] Inventors: Takeshi Wakayama, Ageo; Toshiyuki Komuro, Gunma-Ken; Koji Mori, Ashikaga; Motomi Yamauchi, Kumagaya; Tetsushi Yamashita; Noriaki Kobayashi, both of Gunma-Ken, all of Japan

[73] Assignee: Sanyo Electirc Co., Ltd., Osaka, Japan

[21] Appl. No.: 655,825

[22] Filed: May 31, 1996

[30] Foreign Application Priority Data

Aug. 23, 1995 [JP] Japan ..... 7-214912

[51] Int. Cl.[6] ..... F25D 17/04

[52] U.S. Cl. ..... 62/407; 62/262; 454/190

[58] Field of Search ..... 62/262, 404, 407; 454/190, 188; 415/208.1, 211.1, 211.2, 206, 914

[56] References Cited

U.S. PATENT DOCUMENTS 3,211,077 10/1965 Kramer, Jr. ..... 454/190

FOREIGN PATENT DOCUMENTS 5-180463 7/1993 Japan .
5-196252 8/1993 Japan .
5-223227 8/1993 Japan .

*Primary Examiner*—John M. Sollecito
*Attorney, Agent, or Firm*—Wenderoth, Lind & Ponack

[57] ABSTRACT

Air direction changing members are disposed in an air inversion course so that the flows of air blown from a blow port of a front panel becomes substantially uniform throughout the whole of the blow port.

12 Claims, 5 Drawing Sheets

AIR CONDITIONER AIR TURNING VANE

BACKGROUND OF THE INVENTION

This invention relates to an air-conditioner which blows air sucked from a suction port of a front panel from a blow port of the front panel through an air inversion course.

In the shape and structure of a casing of an air-conditioner according to the prior art shown in FIG. 10, air sucked by a Sirocco fan 2 through a suction port 1 is blown from a blow port 4 through an air inversion course 3.

According to the conventional structure, however, sucked air flows along a wall 5 of the air inversion course 3. Therefore, as represented by the distribution of arrows in FIG. 10 of the drawing, the flow of air is stronger on the wall (5) side and is weaker at portions far from the wall 5, and there involves the problem that the flow of air does not expand. Unless the flow of air (i.e. the amount of air flow); is substantially uniform throughout the whole of the blow port 4, it becomes difficult to blow air into the entire portion of a room, and effective utilization of heat cannot be accomplished.

SUMMARY OF THE INVENTION

It is therefore an object of the present invention to provide an air-conditioner which can solve the problems of the conventional air-conditioner described above, and which can uniform make the flow of air (i.e. the amount of air flow); blown from a blow port substantially throughout the whole of the blow port.

In a first aspect of the invention, there is provided an air-conditioner for blowing air sucked from a suction port of a front panel from a blow port of the front panel through an air inversion course, in which air direction changing means is disposed in the air inversion course so that the flow of air blown from the blow port of the front panel becomes substantially uniform throughout the whole of the blow port.

According to this structure, the flow of air blown from the blow port of the front panel becomes substantially uniform due to the provision of the air direction changing means disposed in the air inversion course. Accordingly, air can be dispersedly blown into the whole room, and the air flow can be made uniform and expanded.

In a second aspect of the invention, there is provided an air-conditioner for blowing air sucked from a suction port of a front panel from a blow port of the front panel through an air inversion course, in which an air direction changing means is disposed in the air inversion course so that the flow of air blown from the blow port of the front panel becomes substantially uniform. The air inversion course is bent substantially at a right angle, and the air direction changing means protrudes into the air inversion course so as to change the inversion angle of the air.

In this structure of the second aspect of the invention, the flow of air blown from the blow port of the front panel is bent substantially at a right angle by the air inversion course and moreover, the air direction changing means changes the inversion angle of the air. Therefore, the flow of air becomes substantially uniform, and hence, the air can be dispersed into the whole room, and the air flow can be made uniformed and expanded.

In a third aspect of the invention, there is provided an air-conditioner for blowing air sucked from a suction port of a front panel from a blow port of the front panel through an air inversion course, in which the air inversion course is divided into a plurality of sections so that the flow of air blown from the blow port of the front panel becomes substantially uniform, an air direction changing means having a different angle is disposed in each of the sections of the course so divided, and the air whose direction is inverted by each air direction changing means is guided to the blow port of the front panel.

According to this structure, air flowing through each of a plurality of upper and lower divided sections of the air inversion course is inverted by each air direction changing means and is then guided to the blow port. Therefore, the flow of air becomes substantially uniform, and hence, the air can be dispersed into the whole room, and the air flow can be made uniformed and expanded.

The fourth aspect of the invention provides an air-conditioner including a heat exchanger on the outdoor side, a fan on the room side, a compressor, an expansion device, a heat exchanger on the indoor side, a fan on the indoor side and a motor for driving both of the fans, all such elements being accommodated in a single casing equipped with a front panel having a section port and a blow port. Also disposed inside the casing is; an inner casing for subjecting air sucked from the suction port of the front panel to cause heat-exchange by the operation of the fan on the room side through the heat exchanger on the room side, inverting the direction of air flow so subjected to heat exchange through an air inversion course and guiding the air to the blow port of the front panel. An air direction changing means is disposed in the air inversion course of the inner casing, and the air direction changing means is constituted so as to change the direction of air flow so that the flow of air blown from the blow port becomes substantially uniform.

In the structure of the fourth aspect of the invention described above, the air inversion course can be bent substantially at a right angle, and the air direction changing means can protrude into the air inversion course so as to change the inversion angle of the air.

Further, the fourth aspect of the invention described above can have the structure wherein the air inversion course is divided into a plurality of sections, an air direction changing means having a different angle is disposed in each of the sections of the air inversion course so divided, and each air direction changing means changes the direction of the flow of air at a different angle.

In any of the aspects of the invention described above, the air direction changing means can be a protuberance having a triangular pyramid shape.

According to the fourth aspect of the invention and its modifications, the flow of air blown from the blow port of the front panel becomes substantially uniform due to the provision of the air direction changing means disposed in the air inversion course. Accordingly, the air can be dispersed into the whole room, and the air flow can be made uniform and can be expanded.

PREFERRED EMBODIMENTS OF THE INVENTION

Hereinafter, an embodiment of the present invention will be explained with reference to the accompanying drawings.

Figure 1:
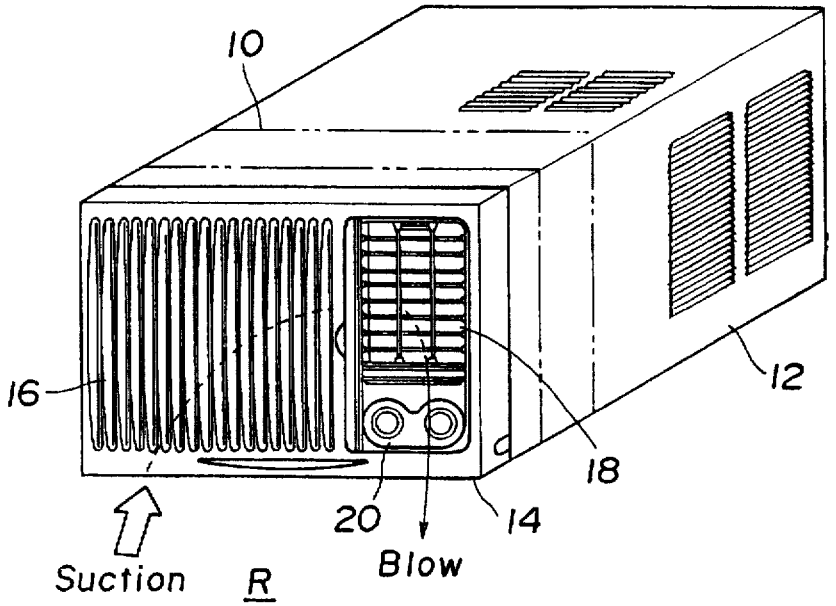
FIG. 1 is a perspective view showing an air-conditioner of an embodiment according to the present invention.

FIG. 1 shows an air-conditioner of an embodiment of the present invention, and this air-conditioner is of the type which can be installed in a window, for example.

The portion of this air-conditioner represented by two-dot-chain lines is fitted into a hole of a window frame 10, and is equipped with a casing 12 and a front panel 14. A suction port 16, a blow port 18 and an operation portion 20 are provided to this front panel 14. The front panel 14 is disposed on the room side, while the casing 12 is disposed outside the window frame 10.

Figure 2:
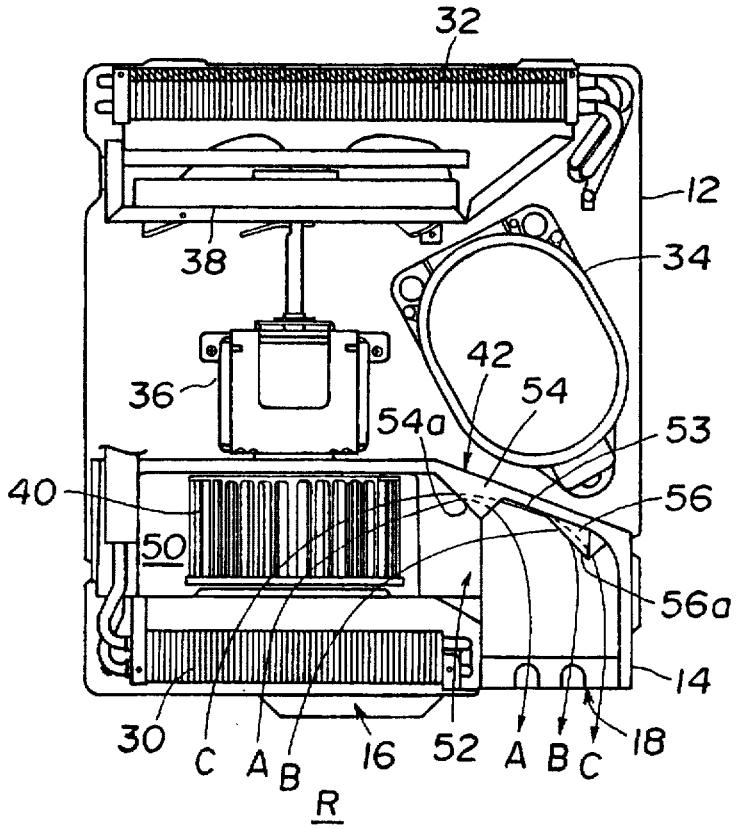
FIG. 2 is transverse sectional view showing the inside of the air-conditioner.
Figure 3:
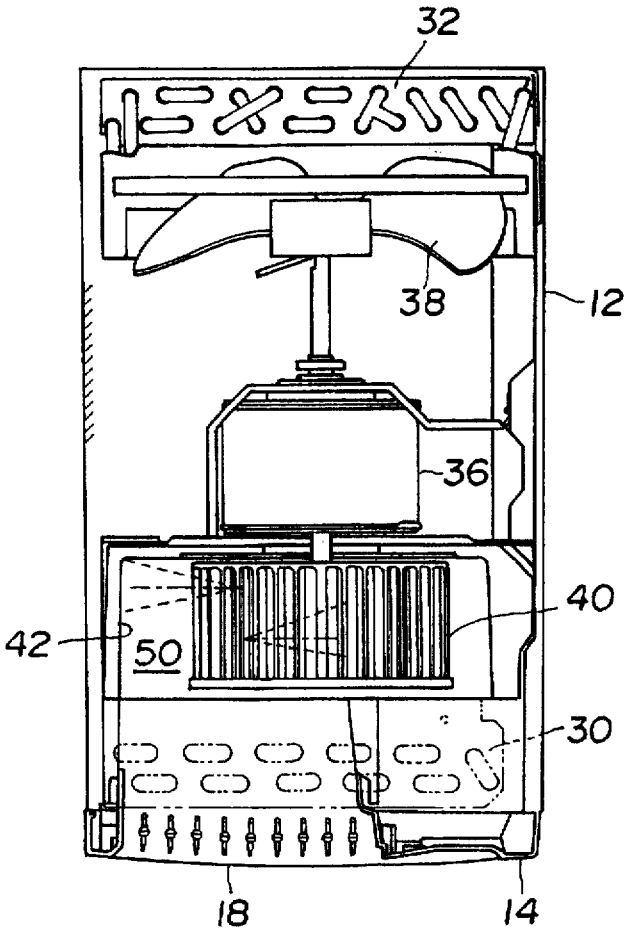
FIG. 3 is a longitudinal sectional view.

FIGS. 2 and 3 show the inside of the air-conditioner shown in

1.

A heat exchanger 30 on the room side, a heat exchanger 32 on the outdoor side, a compressor 34, a fan motor 36, an outdoor fan 38 connected to one of the ends of the fan motor 36, a room fan (hereinafter referred to as a "Sirocco fan") 40 connected to the other end of the fan motor 36, an inner casing 42, etc. are disposed below a board inside the casing 12. The heat exchanger 32 on the outdoor side is disposed at the rear end portion of the casing 12 and the heat exchanger 30 on the room side is so disposed as to correspond to the suction port 16 of the front panel 14. The Sirocco fan 40 is disposed at the back of the heat exchanger 30 on the room side. By the operation of this Sirocco fan 40, air inside a room R is sucked from the suction port 16 of the front panel 14 into a later-described air inversion course 52.

The compressor 34 and the fan motor 36 are disposed the substantial center inside the casing 12. The fan motor 36 rotates the outdoor fan 38.

Figure 4:
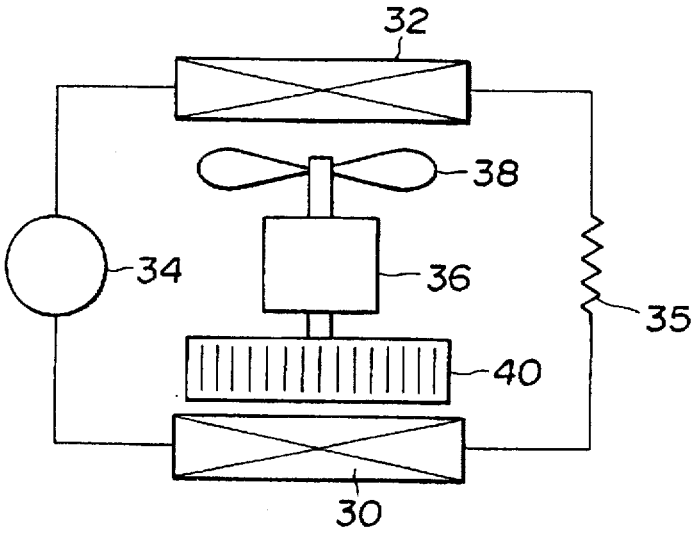
FIG. 4 is a cooling medium circuit diagram of the air conditioner.

Referring to FIG. 4, the heat exchanger 30 on the indoor side, the heat exchanger 32 on the outdoor side, the compressor 34 and an expansion device 35 are connected by a predetermined refrigeration piping and constitute a refrigeration cycle.

Figure 5:
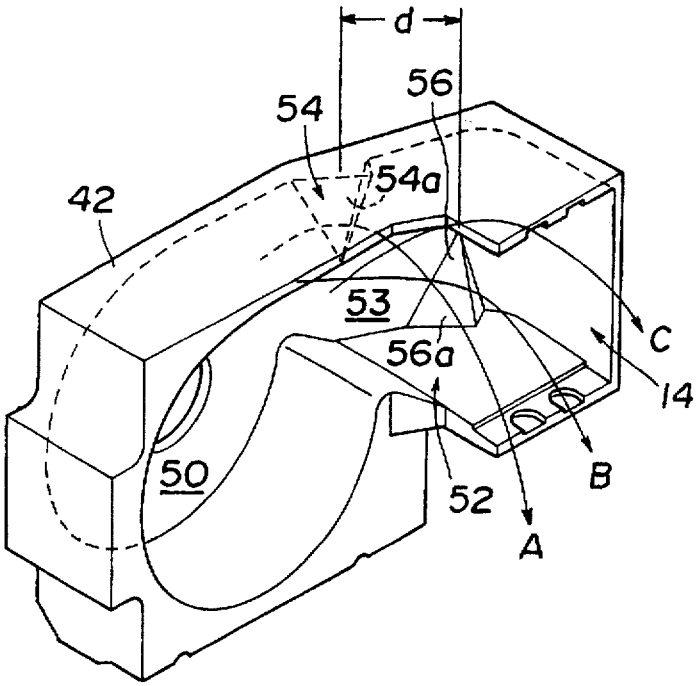
FIG. 5 is a perspective view showing an example of an inner casing of the air-conditioner.
Figure 6:
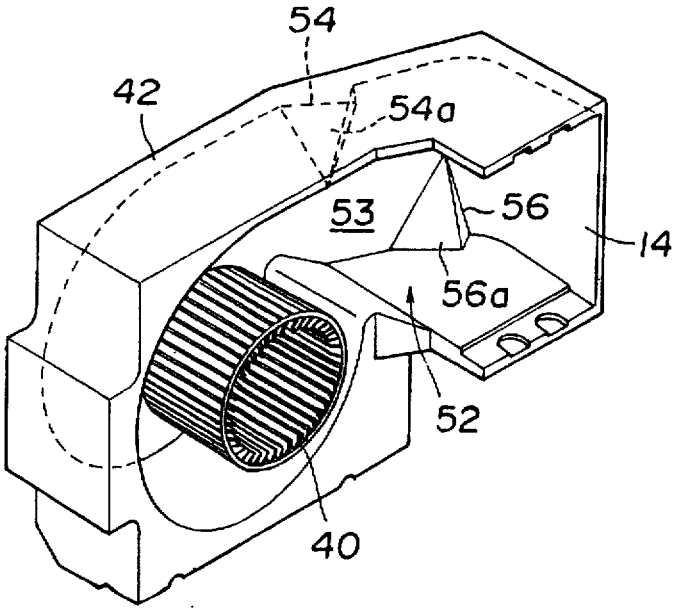
FIG. 6 is a perspective view showing of a Sirocco fan accommodated in the inner casing shown in FIG. 5.

The inner casing 42 shown in FIGS. 5 through 8 is made of a synthetic resin, for example, and is equipped with an accommodation portion 50 for the Sirocco fan 40, the air inversion course 52 and protuberance-like air direction changing members 54 and 56. Referring to FIG. 6, the Sirocco fan 40 is accommodated in the accommodation portion 50 of the inner casing 42 as shown in the drawings.

Air sucked from the suction port 16 of the front panel 14 is blown from the blow port 18 of the front panel 14 through the air inversion course 52 as represented by the flows of air A, B and C (FIGS. 2 and 5). The air direction changing members 54 and 56 described above are disposed in such a manner that the flows of air A, B and C (i.e. the amounts of air flow of the air flows A, B and C); blown from the blow port 18 of the front panel 14 become substantially uniform throughout the whole of the blow port 18.

Figure 7:
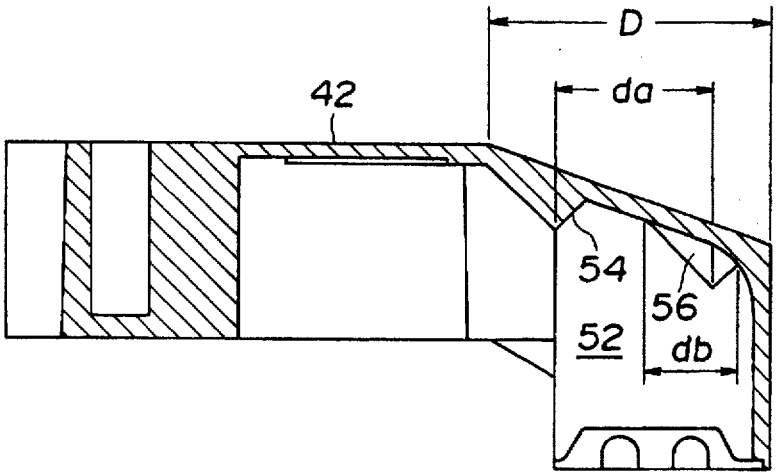
FIG. 7 is a transverse sectional view of the inner casing.
Figure 8:
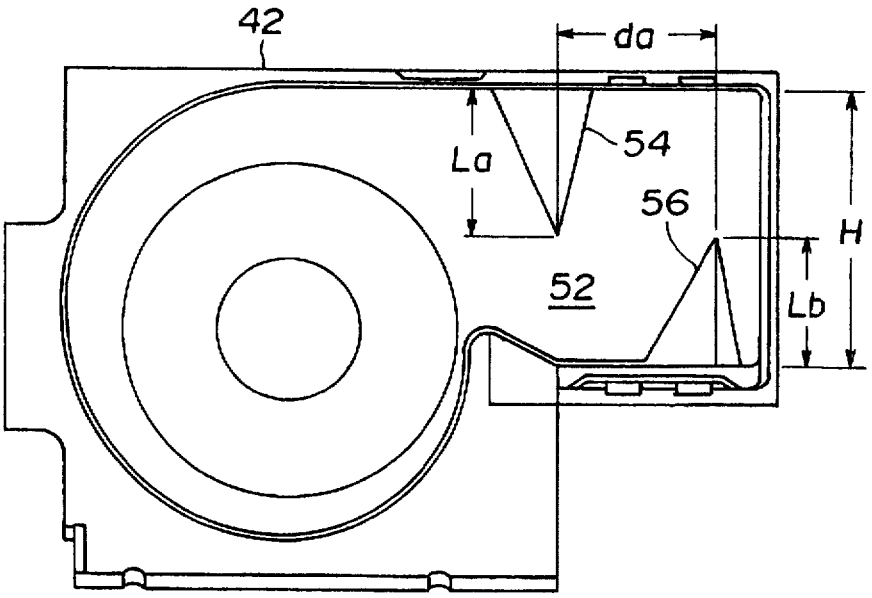
FIG. 8 is a longitudinal sectional view of the inner casing.

As is obvious from FIGS. 7 and 8, the air direction changing member 54 has a substantially triangular pyramid shape and is disposed at an the upper section formed by dividing the air inversion course 52 into upper and lower sections, and the air direction changing member 56 likewise has a substantially triangular pyramid shape and is disposed at the lower section formed by dividing the air inversion course 52 into the upper and lower sections.

Referring to 7, the air direction changing members 54 and 56 are so formed as to be spaced apart from each other at a distance da=90 mm with respect to the direction of flow air when the length D of the air inversion course 52 is, for example, D=162 mm, and the width db of each of the air direction changing members 54 and 56 is db=55 mm. Referring to FIG. 8, when the height H of the air inversion course 52 is H=160 mm, the air direction changing member 54 protrudes into the course 52 by a length La=85 mm, and the other air direction changing member 56 likewise protrudes into the course 52 by a length Lb=75 mm, for example. In other words, each air direction changing member 54, 56 is separated at a suitable dimensional interval in the vertical direction of the air inversion course 52 so that the flows of air A, B and C blown from the blow port 18 become substantially uniform throughout the whole of the blow port 18. As is obvious from FIG. 7, too, the air inversion course 52 is the course which is bent substantially at a right angle, and each of the air direction changing members 54 and 56 protrudes into the air inversion course 52 so as to change the inversion angle of air.

In this embodiment, when the air inside the room R is air-conditioned, the Sirocco fan 40 is rotated and air inside the room R is sucked from the suction port 16 of the front panel 14. The flows of air A, B and C pass through the heat exchanger 30 on the room side, then flow through the respective courses and are blown from the blow port 18 of the front panel 14. In other words, the flow of air A sucked through the suction port 16 passes through the heat exchanger 30 on the room side and through the Sirocco fan 40, strikes the changing surface 54*a* of the air direction changing member 54 having a protuberance-like shape, is then guided obliquely downward, and blown to the left side of the blow port 18 in the drawing after its direction is so changed, as shown in FIGS. 2 and 5.

The flow of air B passes through the heat exchanger 30 on the room side and through the Sirocco fan 40, strikes the changing surface 56*a* of the air direction changing member 56 having a protuberance-like shape, and is blown from the blow port 18 after its direction is so changed. The flow of air C passes through the heat exchanger 30 on the room side and through the Sirocco fan 40, is guided along the air course surface 53 of the air inversion course 52 without striking the protuberance-like air direction changing members 54 and 56, and is blown from the right side of the blow port 18 in the drawing after its direction is so changed.

In this embodiment, the direction of the flows of air A, B and C blown from the blow port 18 of the front panel 14 are changed by the protuberance-like air direction changing members 54 and 56 disposed in the air inversion course 52, and the flows are made substantially uniform throughout the whole of the blow port 18 as shown in FIG. 5, for example.

Figure 9:
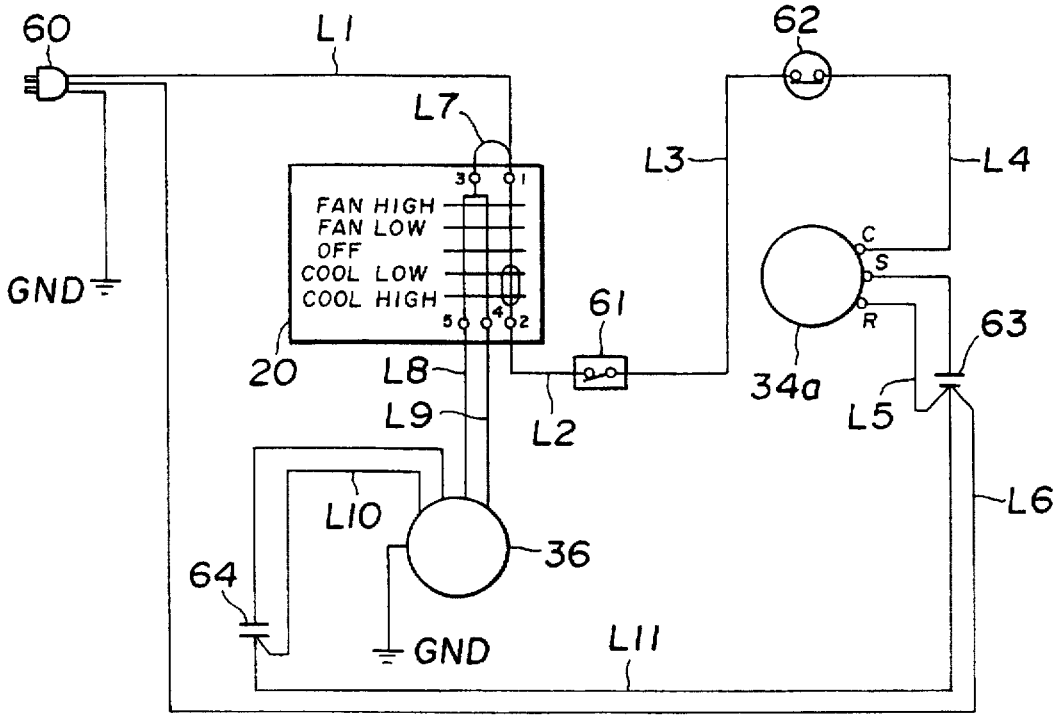
FIG. 9 is an electric circuit diagram of the airconditioner.
Figure 10:
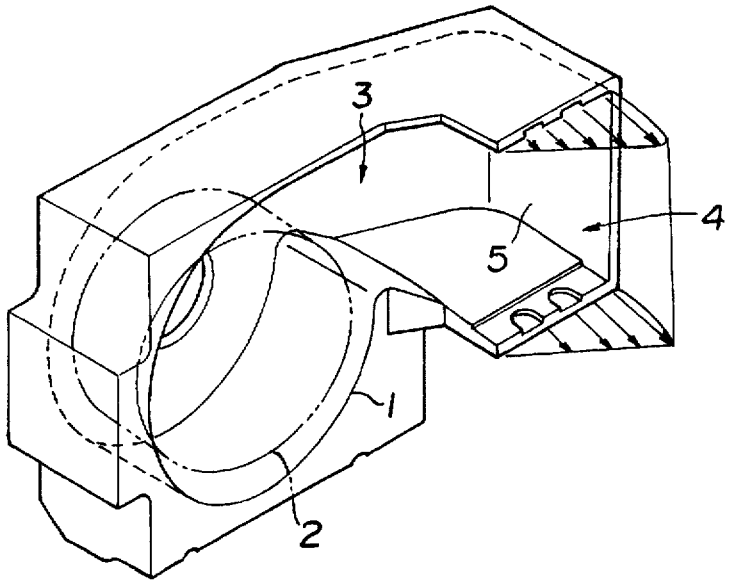
FIG. 10 is a view showing an example of a conventional casing of an air-conditioner according to the prior art.

FIG. 9 shows an example of a driving electrical circuit for driving a compressor motor 34*a* of the compressor 34 and the fan motor 36. In FIG. 9, A.C. power from the power supply plug 60 is supplied to the compressor motor 34*a* and to the fan motor 36 through the operation section 20. In other words, power is supplied to the compressor motor 34*a* through a wiring route comprising one terminal of the power supply plug 60, cables L1, L2, L3, L4, L5 and L6 and the power supply plug 60. Power is supplied to the fan motor 36 through a wiring route comprising the other terminal of the power supply plug 60, L1, L7, L8 or L9, L10, L6 and the power supply plug 60. A thermostat 61 using a bimetal as a temperature detection/protection device and an overcurrent relay 62 as an overcurrent protection device are inserted into the wiring route between the operation section 20 and the compressor motor 34*a*. Through the operation section 20, power supply can be turned OFF, and the flow rate adjustment of the fan motor 36 (high and low two-stage switching) and the high and low two-stage switching of the cooling operation can be set. Incidentally, reference numerals 63 and 64 denote capacitors for improving the power factor and for preventing noise, respectively.

Referring to FIG. 9, when the blow rate is adjusted, the blow rate is set to "HIGH" through the operation section 20 when a strong (high) blow rate is required. Then, the power supply is switched to the "HIGH" rotation side through the terminal number 3 of the operation section 20 and power is supplied to the fan motor 36 through the wiring L8, so that the fan motor 36 rotates at a high speed. For a weak (low) blow rate, on the other hand, the blow rate is set to "LOW" through the operation section 20. Then, the power supply is switched to the "LOW" circuit side through the terminal number 1 of the operation section 20, and power is supplied to the fan motor 36 through the wiring L9, so that the fan motor 36 rotates at a low speed.

Next, when cooling is set to "HIGH" through the operation section 20, power is supplied to the terminals C and R of the compressor motor 34*a* through the terminal number 1 of the operation section 20, the wiring L2, the thermostat 61, the wiring L3, the overcurrent relay 62 and the wiring L4 and through the wiring L5 and L6, and the compressor motor 34*a* is driven. At this time, the power supply is switched to the "HIGH" rotation side through the terminal number 3 of the operation section 20 and power is supplied also to the fan motor 36 through the wiring L8, so that the fan motor 36 rotates at a high speed. On the other hand, when cooling is set to the "LOW" through the operation section 20, power is supplied to the terminals C and R of the compressor motor 34*a* through the terminal number 1 of the operation portion 20, the wiring L2, the thermostat 61, the wiring L3, the overcurrent relay 62 and the wiring L4 and through the wirings L5 and L6, so that the compressor motor 34*a* is driven. At this time, the power supply is switched to the "LOW" circuit side through the terminal number 3 of the operation portion 20 and power is supplied to the fan motor 36, too, through the wiring L9, so that the fan motor 36 rotates at a low speed. In this way, HIGH/LOW switching of cooling is effected by switching of HIGH/LOW of the blow rate by the fan motor 36 while the compressor motor 34*a* is kept rotating at a constant speed.

When the temperature of the compressor motor 34*a* reaches an overheat set temperature, the contact of the thermostat 61 opens, the supply of power to the compressor motor 34*a* is cut off, the rotation of the compressor 34*a* is stopped, and the air-conditioner is protected. When the overcurrent flows through the winding of the compressor motor 34*a*, the overcurrent relay 62 is tripped, the supply of power to the compressor motor 34*a* is similarly cut off, the rotation of the compressor motor 34*a* is stopped, and the air-conditioner is protected.

Though the present invention has thus been described by way of the embodiment thereof, it is obvious that the present invention is not particularly limited thereto.

For example, though two protuberance-like air direction changing members 54 and 56 are disposed in the air inversion course 52 in the foregoing embodiment, three or more protuberance-like air direction changing members may be disposed, as well. Further, the shape of the air direction changing member is not limited to the substantially triangular pyramid shape. Other shapes may also be employed. Though the air-conditioner of the foregoing embodiment is of a window installation type, the present invention can be applied to other types.

As can be understood clearly from the foregoing explanation, according to the first aspect of the invention, when the air sucked from the suction port of the front panel is blown from the blow port of the front panel through the air inversion course, the flows of air can be substantially made uniform throughout the whole of the blow port due to the provision of the air direction changing members in the air inversion course. Therefore, the air can be dispersed into the room as a whole, and can be made uniform in the room.

According to the second aspect of the invention, when the air sucked from the suction port of the front panel is blown from the blow port of the front panel through the air inversion course, it is bent substantially orthogonally by the air inversion course and its inversion angle is changed by the air direction changing members. Therefore, the flows of air can be substantially made uniform throughout the whole of the blow port, and the air can be dispersed into the room as a whole, and can be made uniform in the room.

According to the third aspect of the invention, when the air sucked from the suction port of the front panel is blown from the blow port of the front panel through the air inversion course, the direction of flow of air flowing through a plurality of upper and lower sections of the air inversion course is inverted by the air direction changing member having a mutually different angle and disposed in each section and is then guided to the blow port. Therefore, the flows of air can be substantially made uniform throughout the whole of the blow port, and the air can be dispersed into the room as a whole and can be made uniform.

According to the fourth aspect of the invention and its modifications, further, the flows of air blown from the blow port of the front panel are substantially made uniform due to the provision of the air direction changing members disposed in the air inversion course. Therefore, the air can be dispersed into the room as a whole, and the air flow can be made uniform and expanded extensively in the room.

What is claimed is:

1. An air-conditioner apparatus comprising:

a front end having a suction port for sucking air in a first direction and a blow port for blowing air in a second direction generally opposite said first direction;

an inversion course for inverting the air sucked in through said suction port in said first direction such that the air blows from said-blow port in said second direction, said inversion course comprising a bend and having a rear surface forming an outer circumference of said bend and constituting an *air flow directing surface; and at least one air direction changing member disposed on said rear surface for causing some of the air flow along said rear surface to be changed in direction by deflection away from said rear surface toward an inner circumference of said bend of said air inversion course, so as to cause substantial uniformity in air flow amounts flowing along said rear surface and flowing along said inner circumference of said bend.

2. An air-conditioner apparatus as recited in claim 1, said bend comprises a substantially right angle bend; and said at least one air direction changing member protrudes from said rear surface into said air inversion course.

3. An air-conditioner apparatus as recited in claim 2, wherein said at least one air direction changing member comprises at least one triangular pyramid shaped protuberance protruding from said rear surface in a radially inward direction of said bend.

4. An air-conditioner apparatus as recited in claim 1, wherein in a direction generally perpendicular to a direction of air flow through said air inversion course and generally perpendicular to a radial direction of said bend, said air inversion course is divided into a first section and a second section, and said at least one air direction changing member comprises a first air direction changing member disposed in said first section and a second air direction changing member disposed in said second section.

5. An air-conditioner apparatus as recited in claim 4, wherein said at least one air direction changing member comprises at least one triangular pyramid shaped protuberance protruding from said rear surface in a radially inward direction of said bend.

6. An air-conditioner apparatus as recited in claim 1, wherein said at least one air direction changing member comprises at least one triangular pyramid shaped protuberance protruding from said rear surface in a radially inward direction of said bend.

7. An air-conditioner apparatus comprising:

an outer casing having a room side and an outdoor side;

a front panel mounted to said outer casing on said room side thereof and having a suction port for sucking air in a first direction and a blow port for blowing air in a second direction generally opposite said first direction;

an outdoor side heat exchanger, an outdoor side fan, a compressor, an expansion device, a room side heat exchanger, a room side fan and a motor drivingly connected to said outdoor side fan and said room side fan, mounted in said outer casing and operably arranged to constitute an air-conditioner circuit;

an inner casing mounted in said outer casing and comprising an inversion course for inverting the air sucked in through said suction port in said first direction such that the air blows from said blow port in said second direction, said inversion course comprising a bend and having a rear surface forming an outer circumference of said bend and constituting an air flow directing surface; and at least one air direction changing member disposed on said rear surface for causing some of the air flow along said rear surface to be changed in direction by deflection away from said rear surface toward an inner circumference of said bend of said air inversion course, so as to cause substantial uniformity in air flow amounts flowing along said rear surface and flowing along said inner circumference of said bend.

8. An air-conditioner apparatus as recited in claim 7, said bend comprises a substantially right angle bend; and said at least one air direction changing member protrudes from said rear surface into said air inversion course.

9. An air-conditioner apparatus as recited in claim 8, wherein said at least one air direction changing member comprises at least one triangular pyramid shaped protuberance protruding from said rear surface in a radially inward direction of said bend.

10. An air-conditioner apparatus as recited in claim 7, wherein in a direction generally perpendicular to a direction of air flow through said air inversion course and generally perpendicular to a radial direction of said bend, said air inversion course is divided into a first section and a second section, and said at least one air direction changing member comprises a first air direction changing member disposed in said first section and a second air direction changing member disposed in said second section.

11. An air-conditioner apparatus as recited in claim 10, wherein said at least one air direction changing member comprises at least one triangular pyramid shaped protuberance protruding from said rear surface in a radially inward direction of said bend.

12. An air-conditioner apparatus as recited in claim 7, wherein said at least one air direction changing member comprises at least one triangular pyramid shaped protuberance protruding from said rear surface in a radially inward direction of said bend.

* * * * *